US009415489B2

(12) United States Patent
Xu

(10) Patent No.: US 9,415,489 B2
(45) Date of Patent: Aug. 16, 2016

(54) IMPACT MECHANISM FOR AN ELECTRIC TOOL

(75) Inventor: Xuefeng Xu, Zhejiang Province (CN)

(73) Assignee: WUYI OUOU TOOLS CO., LTD, Wuyi County, Zhejiang Province (CN)

( * ) Notice: Subject to any disclaimer, the term of this patent is extended or adjusted under 35 U.S.C. 154(b) by 663 days.

(21) Appl. No.: 13/823,980

(22) PCT Filed: Nov. 4, 2011

(86) PCT No.: PCT/CN2011/081767
§ 371 (c)(1),
(2), (4) Date: Mar. 15, 2013

(87) PCT Pub. No.: WO2012/062180
PCT Pub. Date: May 18, 2012

(65) Prior Publication Data

US 2013/0168119 A1 Jul. 4, 2013

(30) Foreign Application Priority Data

Nov. 9, 2010 (CN) ..... 2010 2 0612631 U

(51) Int. Cl.
*B25B 21/02* (2006.01)

(52) U.S. Cl.
CPC ..... *B25B 21/02* (2013.01); *B25B 21/026* (2013.01)

(58) Field of Classification Search
CPC .... B25B 21/02; B25B 21/026; B25B 23/141; B25B 23/147; B25B 19/00; H01H 35/10; H01H 35/14
USPC ..... 74/336 R; 173/94, 93, 104; 200/80 R
See application file for complete search history.

(56) References Cited

U.S. PATENT DOCUMENTS 1,880,457 A * 10/1932 Morley ..... F16D 41/063 192/43
2,219,865 A * 10/1940 Fitch ..... B25B 21/026 173/93.6

(Continued)

FOREIGN PATENT DOCUMENTS

| | | | |
|---|---|---|---|
| CN | 201329567 | Y | 10/2009 |
| JP | 8168971 | A | 7/1996 |
| JP | 2004122335 | A | 4/2004 |

*Primary Examiner* — Michelle Lopez
*Assistant Examiner* — Eduardo R Ferrero
(74) *Attorney, Agent, or Firm* — Jiwen Chen

(57) ABSTRACT

An impact mechanism for an electric tool, comprising a transmission mechanism arranged in a housing and driven by a motor (2), whip blocks (7) and a power output member, the whip blocks (7) being driven by the transmission mechanism, and being connected to and driving an output shaft (8), wherein the transmission mechanism comprises a transmission wheel (4), the motor (2) is connected to and drives the transmission shaft (42) of the transmission wheel (4), two grooves (411) are symmetrically arranged on the peripheral wall of the transmission wheel (4), tail portions of the two whip blocks (7) are mounted in the two grooves (422) through wrist pins, respectively; head portions of the two whip blocks (7) are connected to the power output member; and, a first axial hole (421) and a second axial hole (422) are arranged at an interval on the transmission shaft (42) corresponding to the head portions and the tail portions of the whip blocks (7), a spring (5) is received in the first axial hole (421), two ends of the spring (5) abut against the tail portions of the two whip blocks (7), respectively, and a magnet (6) is arranged in the second axial hole (422). The two whip blocks can be whipped at the same time, so that a large output power can be achieved when the motor operates at a low power. As the two whip blocks are symmetrically arranged, dynamic balance can be ensured during operation.

5 Claims, 3 Drawing Sheets

(56) References Cited

U.S. PATENT DOCUMENTS 2,408,335 A * 9/1946 Oliver ..... B25B 23/103 192/38
2,446,923 A * 8/1948 Hardy ..... H01H 35/10 200/318
2,497,361 A * 2/1950 Kesterton ..... F16D 15/00 192/38
2,520,920 A * 9/1950 Fosnot ..... B25B 21/026 173/93.5
2,564,224 A * 8/1951 Mitchell ..... B25B 21/026 173/93.6
2,783,863 A * 3/1957 Shaff ..... B25B 21/02 173/169
3,362,486 A * 1/1968 Alajouanine ..... B25B 21/026 173/93.5
3,603,751 A * 9/1971 Smith ..... H01H 35/10 200/80 R
3,752,277 A * 8/1973 Nakai ..... B25B 23/145 173/178
3,952,814 A * 4/1976 Gelfand ..... B25B 21/02 173/93
4,120,385 A * 10/1978 Roider ..... B60T 8/74 188/181 R
4,232,750 A * 11/1980 Antipov ..... B25B 21/02 173/93.6
4,883,130 A * 11/1989 Dixon ..... B23P 19/06 173/178
4,967,888 A * 11/1990 Lippacher ..... B25B 21/00 173/178
5,040,652 A * 8/1991 Fish ..... E05B 17/0058 192/71
5,134,909 A * 8/1992 Sasaki ..... B25B 21/00 173/176
5,214,819 A * 6/1993 Kirchner ..... A61C 17/26 15/22.1
5,672,110 A * 9/1997 Kurita ..... F16D 7/10 192/45.006
5,722,894 A * 3/1998 Kojima ..... B25F 5/001 192/56.1
5,915,484 A * 6/1999 Hsieh ..... B25B 21/02 173/176
5,984,022 A * 11/1999 Harman, Jr. ..... B25F 5/001 173/176
6,000,512 A * 12/1999 Cronin ..... F16D 41/105 192/38
6,186,247 B1 * 2/2001 Wang ..... B25B 21/00 173/176
6,196,332 B1 * 3/2001 Albert ..... B25B 21/00 173/176
7,134,509 B2 * 11/2006 Rahm ..... B25B 21/00 173/170
7,506,694 B2 * 3/2009 Stirm ..... B25F 5/00 173/176
7,793,560 B2 * 9/2010 Bodine ..... F16D 7/002 192/104 C

* cited by examiner

IMPACT MECHANISM FOR AN ELECTRIC TOOL

This is a U.S. national stage application of PCT Application No. PCT/CN2011/081767 under 35 U.S.C. 371, filed Nov. 4, 2011 in Chinese, claiming the priority benefit of Chinese Application No. 201020612631.6, filed Nov. 9, 2010, which is hereby incorporated by reference.

TECHNICAL FIELD

The invention relates to the field of electric tools, in particular to an impact mechanism for an electric tool.

BACKGROUND OF THE INVENTION

Electric wrenches are tools powered by power supplies or batteries and used for tightening bolts. The electric wrenches mainly include impact wrenches, shear wrenches, constant torque wrenches, torque angle wrenches, angle wrenches, hydraulic wrenches, torque wrenches, rechargeable electric wrenches and the like. The electric wrenches have the characteristics of convenient operation and time and labor conservation. As they are mainly used for mounting high-strength bolts of steel structures in the steel structure installation industry, high demands are proposed on the torque of the wrenches.

In the prior art, the work of an electric wrench generally involves a motor connected with a power supply and a transmission mechanism driven by the motor. Energy is transferred to a whip block by the transmission mechanism, and the work task is accomplished by means of striking a working head by the whip block.

However, the impact mechanism of such structure is provided with only one whip block which, when working, causes quite a few separations in the housing. As such, the output efficiency is reduced and the toque is low. In addition, in order to achieve periodic striking, an eccentric wheel or an asymmetric structure are usually adopted as the structure of the whip block, so dynamic balance of the whip block during the operation cannot be ensured.

SUMMARY OF THE INVENTION

The technical problem to be solved by the invention is to provide, in view of the prior art, an impact mechanism for an electric tool, which has a large toque and good dynamic balance.

The following technical solution is adopted in the invention to solve the aforesaid technical problem: the impact mechanism for an electric tool comprises a transmission mechanism arranged in a housing and driven by a motor, whip blocks and a power output member; the whip blocks are driven by the transmission mechanism, and are connected to and drive an output shaft, wherein the transmission mechanism comprises a transmission wheel, the motor is connected to and drives the transmission shaft of the transmission wheel, two grooves are symmetrically arranged on the peripheral wall of the transmission wheel, tail portions of the two whip blocks are mounted in the two grooves through wrist pins, respectively; head portions of the two whip blocks are connected to the power output member; a first axial hole and a second axial hole are arranged at an interval on the transmission shaft corresponding to the head portions and the tail portions of the whip blocks, a spring is received in the first axial hole, two ends of the spring abut against the tail portions of the two whip blocks, respectively, and a magnet is arranged in the second axial hole, such that the two whip blocks are whipped at the same time.

The transmission wheel is connected with the motor by a clutch.

The clutch comprises a driving wheel connected with the output shaft of the motor and a driven wheel sleeved on the exterior of the driving wheel. The peripheral wall of the driving wheel is provided with small grooves symmetrical to each other and steel balls are arranged in each of the groove. A gap is arranged between the inner wall of the driven wheel and the outer wall of the driving wheel, and the driven wheel is connected with the transmission shaft.

The inner peripheral wall of the driven wheel is uneven.

The power output member is a rotatable power output shaft, the tail portion of the power output shaft is provided with a receiving groove, an opening of which faces the transmission wheel, and the head portions of the whip blocks are received in the receiving groove and the transmission shaft is connected onto a bottom surface of the receiving groove.

Compared with the prior art, the impact mechanism for an electric wrench is provided with two whip blocks. It stores energy by using the spring and whips the two whip blocks at the same time by using the magnet, so that a large output power can be achieved when the motor operates at a low power. Besides, as the two whip blocks are symmetrically arranged, a dynamic balance can be ensured during operation. The arrangement of the clutch between the transmission wheel and the motor allows the impact mechanism to operate more stably. The steel balls are used as engaging members for the clutch, thus achieving the advantages of long service life, low cost, low temperature rise during the operation, among other things.

DETAILED DESCRIPTION OF THE INVENTION

The invention will be further described in details below with reference to drawings and embodiments.

Figure 1:
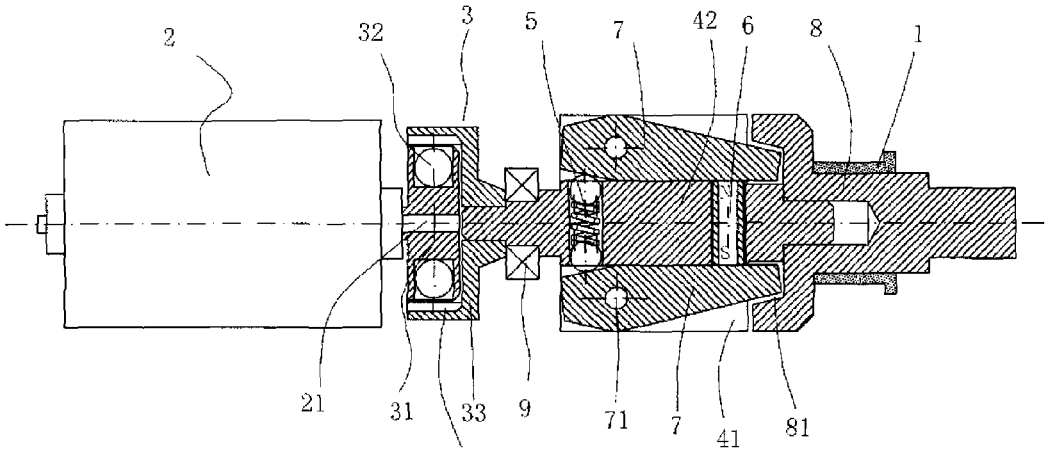
FIG. 1 is a sectional view of an assembled structure of embodiments of the invention.
Figure 2:
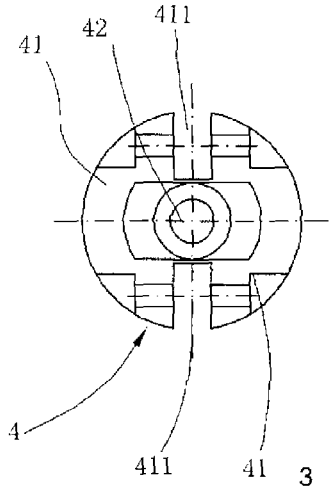
FIG. 2 to FIG. 4 are schematic plans of the transmission wheel in the embodiments of the invention.
Figure 3:
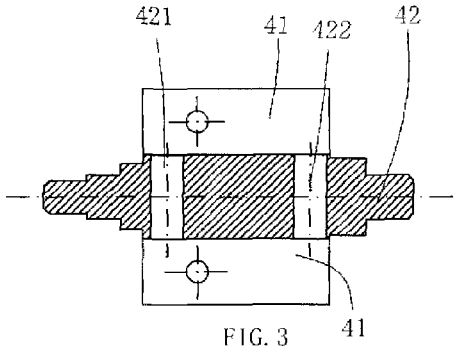
Figure 4:
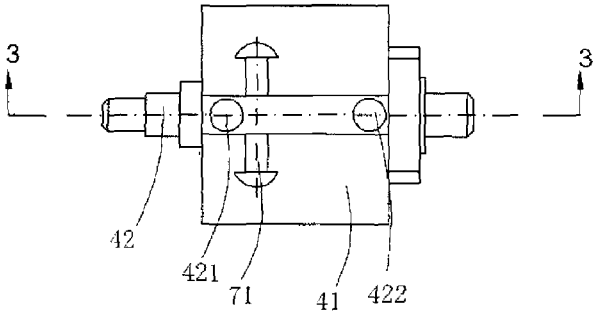
Figure 5:
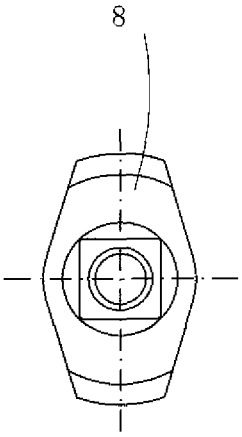
FIG. 5 to FIG. 7 are schematic plans of the output shaft in the embodiments of the invention.
Figure 6:
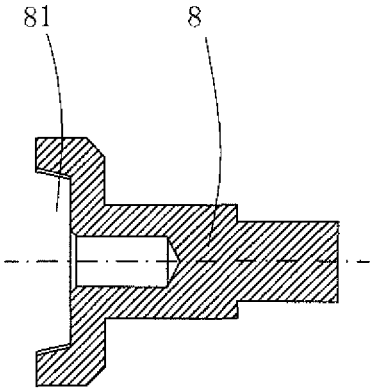
Figure 7:
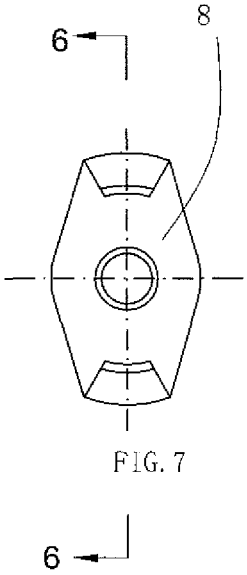
Figure 8:
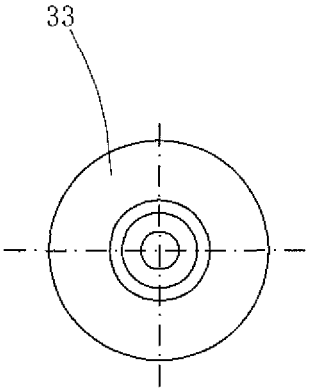
FIG. 8 to FIG. 10 are schematic plans of the driven wheel in the embodiments of the invention.
Figure 9:
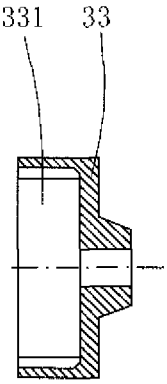
Figure 10:
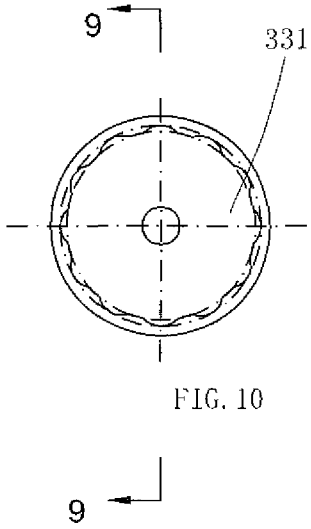
Figures 11, 12, 13:
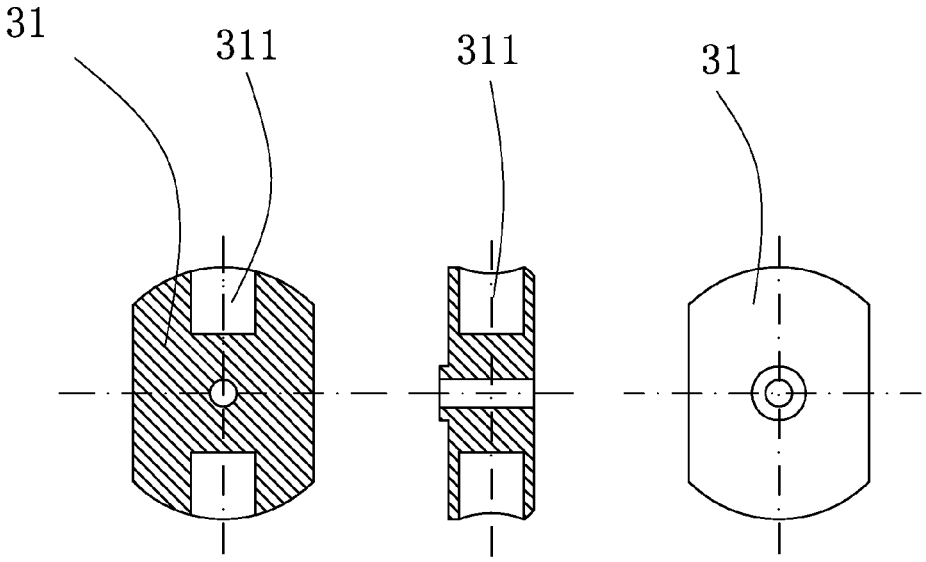
FIG. 11 to FIG. 13 are schematic plans of the driving wheel in the embodiments of the invention.
Figure 14:
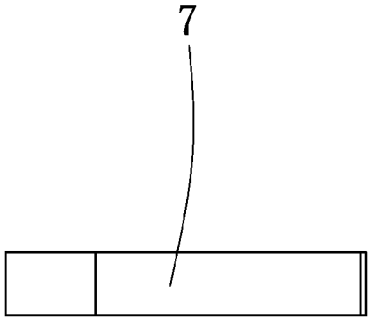
FIG. 14 and FIG. 15 are schematic plans of the whip blocks in the embodiments of the invention.
Figure 15:
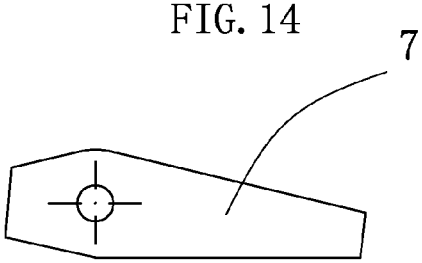

As shown in FIG. 1 to FIG. 15, the impact mechanism for an electric wrench comprises the following components arranged in a housing (not shown in the figures):

a motor 2, located at a tail portion of the housing, serving as a driving device for the electric wrench and capable of being connected with an external power supply through a conductive wire or a battery;

a clutch 3, comprising a driving wheel 31, steel balls 32 and a driven wheel 33; wherein the driving wheel 31 is fixedly connected with an output shaft 21 of the motor 2, a peripheral wall of the driving wheel 31 is provided with two small grooves 311 symmetrical to each other, and there may be more small grooves 311 as needed; the two steel balls 32 are received in each of the small grooves 311, respectively; the driven wheel 33 is U-shaped, a wheel concave 331 in the middle of the driven wheel 33 is sleeved on the exterior of the driving wheel 31, the inner diameter of the wheel concave 331 is larger than the outer diameter of the driving wheel 31, a gap is arranged between the wheel concave 331 and the driving wheel 31, the inner wall of the wheel concave 331 is uneven, and such structure can be achieved by disposing a plurality of shallow grooves on the inner wall of the wheel concave 331;

a transmission wheel 4, comprising a wheel body 41 and a transmission shaft 42 arranged at the axis of the wheel body; wherein, one end of the transmission shaft 42 is coaxially connected with the driven wheel 33, and the abutted portion between the transmission shaft 42 and the driven wheel 33 is arranged on a first bearing 9 for purpose of improving the operation stability and prolonging the service life of components; and the other end of the transmission shaft 42 is operatively connected with an output shaft 8 mentioned below; a first axial hole 421 and a second axial hole 422 are arranged at an interval on the head portion and the tail portion of the transmission shaft along a direction perpendicular to the axis of the transmission shaft; a spring 5 is received in the first axial hole 421, and a magnet 6 is arranged in the second axial hole 422; two grooves 411 are symmetrically arranged on the peripheral wall of the wheel body 41 so that the wheel body 41 is separated into two half wheel bodies symmetrical to each other; two pin shafts 71 are arranged in the two grooves 411, respectively, and two ends of each pin shaft 71 are fixed on the two half wheel bodies, respectively; and the tail portions of the two whip blocks 7 are respectively connected onto corresponding pin shafts 71 through wrist pins;

two whip blocks 7, the tail portions of each one of which are mounted in the two grooves 411 through the pin shafts 71, respectively; wherein two ends of the spring 5 abut against the tail portions of the two whip blocks 7, respectively, and two ends of the magnet 6 are aligned with the head portions of the two whip blocks 7; and an output shaft 8, arranged between the transmission wheel and a working head (not shown in the figures) and transferring kinetic energy of the impact mechanism onto the working head for operation; wherein the tail portion of the output shaft 8 is provided with a receiving groove 81, the opening of which faces the transmission wheel 4, and the head portions of the two whip blocks 7 are received in the receiving groove; the other end of the transmission shaft 42 is operatively connected onto a bottom surface of the receiving groove 81; and the head portion of the output shaft 8 is arranged on a second bearing 1.

When energized, the motor 2 drives the driving wheel 31 to rotate. The steel balls 32 located in the small grooves 311 move outwards under a centrifugal force and generate certain pressure to squeeze the driven wheel when contacting the inner wall of the wheel concave 331, so that a friction force is generated to drive the driven wheel. As the inner wall of the wheel concave 331 is designed to be of an uneven structure, the friction between the steel balls and the driven wheel 33 can be greatly increased so that the driven wheel can rotate quickly. As the driven wheel 33 is fixedly connected with the transmission wheel 4 to drive the transmission wheel to rotate, after a certain time, the transmission wheel reaches a certain rotational speed, the two whip blocks 7 arranged on the transmission wheel overcome the pressure of the spring 5 and the attraction of the magnet 6, whip heads rotate outwards instantaneously, the head portions of the whip blocks 7 immediately strike the output shaft 8 to generate a great torque instantaneously and further to bring the working head to work at a great acting force.

The invention claimed is:

1. An impact mechanism for an electric tool, comprising a transmission mechanism arranged in a housing and driven by a motor, whip blocks and a power output member, the whip blocks being driven by the transmission mechanism, and being connected to and driving an output shaft, wherein the transmission mechanism comprises a transmission wheel, the motor is connected to and drives a transmission shaft of the transmission wheel, two grooves are symmetrically arranged on a peripheral wall of the transmission wheel, tail portions of the two whip blocks are mounted in the two grooves through wrist pins, respectively; head portions of the two whip blocks are connected to the power output member; and, a first axial hole and a second axial hole are arranged at an interval on the transmission shaft corresponding to the head portions and the tail portions of the whip blocks, a spring is received in the first axial hole, two ends of the spring abut against the tail portions of the two whip blocks respectively, and a magnet is arranged in the second axial hole, so that the two whip blocks are whipped at the same time; wherein the magnet is placed in such a position inside the second axial hole that a line connecting north pole and south pole of the magnet is perpendicular to the transmission shaft; and wherein an axis line of the transmission shaft intersects with a middle point of the line connecting the north pole and the south pole.

2. The impact mechanism for an electric tool according to claim 1, wherein the transmission wheel is connected with the motor by a clutch.

3. The impact mechanism for an electric tool according to claim 2, wherein the clutch comprises a driving wheel connected with the output shaft of the motor and a driven wheel sleeved on an exterior of the driving wheel; and, a peripheral wall of the driving wheel is provided with small grooves symmetrical to each other and steel balls are arranged in each of the small grooves, a gap is arranged between an inner wall of the driven wheel and an outer wall of the driving wheel, and the driven wheel is connected with the transmission shaft.

4. The impact mechanism for an electric tool according to claim 3, wherein surface of the inner peripheral wall of the driven wheel is uneven.

5. The impact mechanism for an electric tool according to claim 1, wherein the power output member is a rotatable power output shaft, a tail portion of the power output shaft is provided with a receiving groove, an opening of which faces the transmission wheel, and the head portions of the whip blocks are received in the receiving groove and the transmission shaft is connected onto a bottom surface of the receiving groove.

* * * * *